US006564399B1

(12) United States Patent
Teal

(10) Patent No.: US 6,564,399 B1
(45) Date of Patent: May 20, 2003

(54) FLUSHABLE BOWL PROTECTING LINER

(76) Inventor: Graham M. Teal, 5 The Courtyard, Ecton Hall, Ecton, Northampton NN6 0QE (GB)

( * ) Notice: Subject to any disclaimer, the term of this patent is extended or adjusted under 35 U.S.C. 154(b) by 0 days.

(21) Appl. No.: 10/108,314

(22) Filed: Mar. 28, 2002

(51) Int. Cl.[7] ..... E03D 9/00
(52) U.S. Cl. ..... 4/661; 4/300.3; 4/DIG. 18
(58) Field of Search ..... 4/300.3, 655, DIG. 18, 4/661

(56) References Cited

U.S. PATENT DOCUMENTS

| | | | | |
|---|---|---|---|---|
| 3,071,289 A | | 1/1963 | Taylor | |
| 4,010,497 A | * | 3/1977 | Menter et al. | 4/300.3 |
| 4,979,237 A | | 12/1990 | Hazar et al. | |
| D341,414 S | * | 11/1993 | Baker | 4/661 X |
| 5,330,811 A | | 7/1994 | Buchalter | |
| 5,611,092 A | | 3/1997 | Van Dusen | |
| 5,745,929 A | | 5/1998 | Sobieralski | |
| 5,985,396 A | | 11/1999 | Kerins et al. | |
| 6,081,937 A | * | 7/2000 | Whitacre | 4/300.3 |
| 6,374,428 B1 | * | 4/2002 | Copeland et al. | 4/300.3 |

* cited by examiner

*Primary Examiner*—Charles E. Phillips

(57) ABSTRACT

A flushable bowl protecting liner for reducing the need for manual cleaning by providing a barrier between the bowl of the toilet and solid waste. The flushable bowl protecting liner includes a barrier material that is flat and rigid when dry and rendered flexible when in contact with water. In its' dry state the liner may set into a toilet bowl above the water level. As solid waste is deposited onto the material the moisture would allow the material to wrap about the waste material. By reason of the barrier's design pattern of radial incisions the waste would be fully enclosed. The material would provide not only a barrier to prevent the deposit of solid waste on the toilet bowl but a low friction package that would prevent plumbing blockages. The material may also be designed to be biodegradable.

18 Claims, 2 Drawing Sheets

FLUSHABLE BOWL PROTECTING LINER

BACKGROUND OF THE INVENTION

1. Field of the Invention

The present invention relates to disposable toilet bowl liner and more particularly pertains to a new flushable bowl protecting liner for reducing the need for manual cleaning by providing a barrier between the bowl of the toilet and solid waste.

2. Description of the Prior Art

The use of disposable toilet bowl liner is known in the prior art. More specifically, disposable toilet bowl liner heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,071,289, that teaches a variety of designs for dispenser for paper products, which includes toilet seat covers. The patent does not teach the use of bowl liners to enclose solid waste.

U.S. Pat. No. 4,979,237 teaches a disposable toilet seat cover. The patent does not teach the use of bowl liners to enclose solid waste.

U.S. Pat. No. 5,611,092 teaches a child's training toilet with a disposable liner. The liner designed to be used with a dry or non-flushing toilet. The patent does not teach the use of a liner designed for use in conjunction with a standard flush toilet.

U.S. Pat. No. 5,330,811 teaches a drain liner for improving the visual appearance of a drain. The patent does not teach a disposable or flushable liner that would be replaced with every use.

U.S. Pat. No. 5,745,929 teaches a covering for a toilet seat and external portion of the toilet bowl. The patent does not teach the use of bowl liners to enclose solid waste.

U.S. Pat. No. 5,985,396 teaches a material film that maintains its' strength and integrity when in use but disperses when placed in contact with water. Although the material could be used in conjunction with the invention the patent does not teach a physical design for a toilet bowl barrier that deforms into a shape for enclosing solid waste to prevent contact with the toilet bowl.

While these devices fulfill their respective, particular objectives and requirements, the aforementioned patents do not disclose a new flushable bowl protecting liner. The flushable bowl protecting liner according to the present invention substantially departs from the conventional concepts and designs of the prior art, and in so doing provides an apparatus primarily developed for the purpose of reducing the need for manual cleaning by providing a barrier between the bowl of the toilet and solid waste.

SUMMARY OF THE FLUSHABLE BOWL PROTECTING LINER

In view of the foregoing disadvantages inherent in the known types of disposable toilet bowl liner now present in the prior art, the present invention provides a new flushable bowl protecting liner construction wherein the same can be utilized for reducing the need for manual cleaning by providing a barrier between the bowl of the toilet and solid waste.

To attain these benefits, the present invention generally comprises a material shield designed to be placed into the toilet bowl that would enclose solid waste to prevent contact between the solid waste and the bowl.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
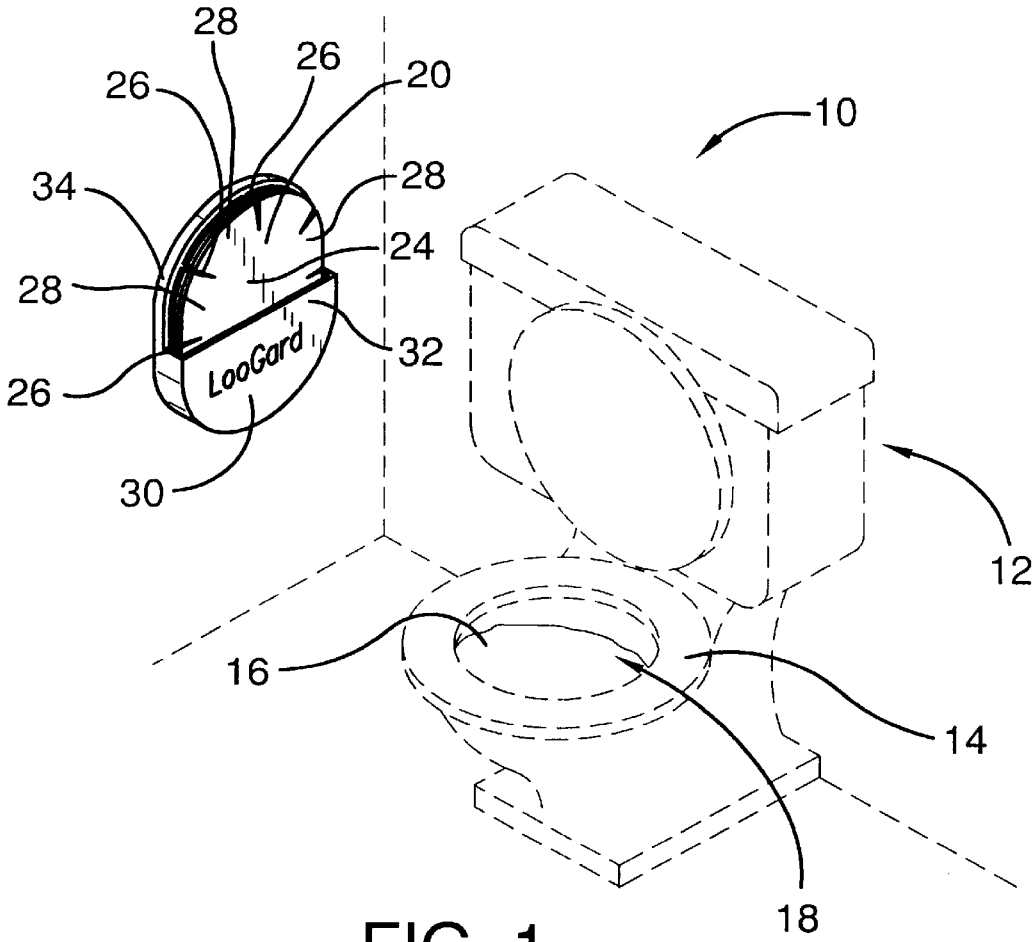
FIG. 1 is a perspective view of a new flushable, bowl protecting liner according to the present invention.
Figure 2:
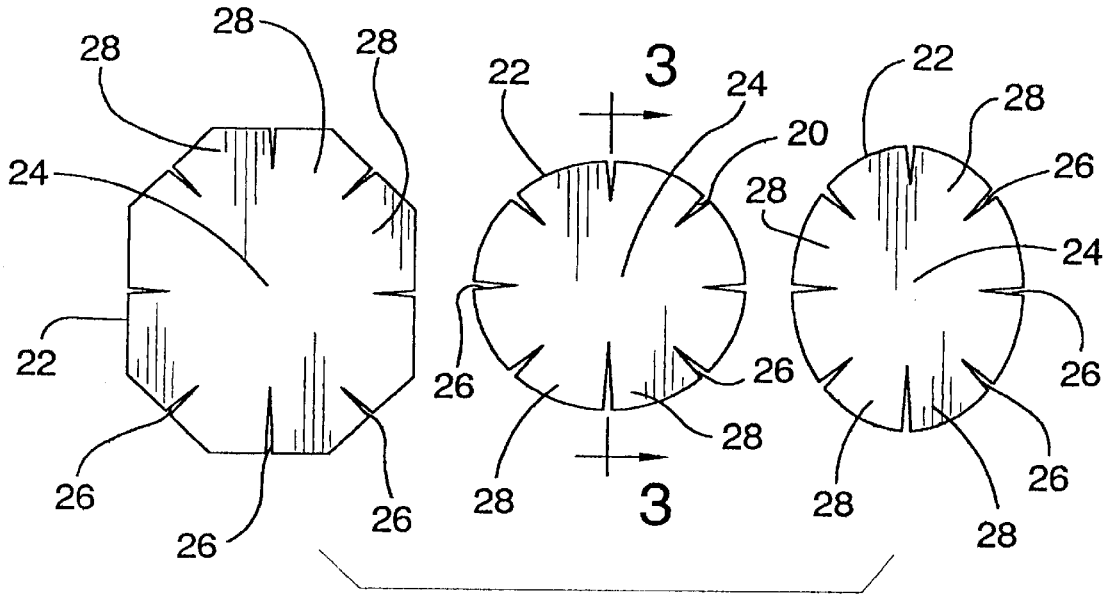
FIG. 2 is a top view of several variations on the design pattern of the present invention.
Figure 3:
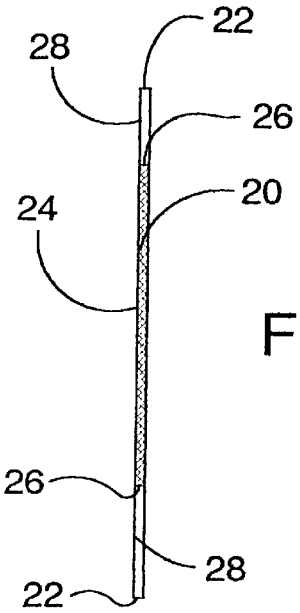
FIG. 3 is a cross sectional view of the present invention.

With reference now to the drawings, and in particular to FIGS. 1 through 3 thereof, a new flushable bowl protecting liner embodying the principles and concepts of the present invention and generally designated by the reference numeral 10 will be described.

As best illustrated in FIGS. 1 through 3, the flushable bowl protecting liner 10 generally comprises a liner 20 constructed from a water sensitive film. Examples of water-sensitive films for use as flushable products are taught, for example, in U.S. Pat. No. 5,985,396. The material maintains its structural integrity and strength when in use, but disperses when placed in contact with water. A water-sensitive film may comprise a laminate of paper or cellulose combined with a water sensitive component, such as, for example, polyethylene oxide, ethylene oxide-propylene oxide copolymers, polymethacrylic acids polymethacrylic acid copolymers, polyvinyl alcohol, poly(2-ethyl oxazoline), polyvinyl methyl ether, polyvinyl pyrrolidone/vinyl acetate copolymers, methylcellulose, ethyl cellulose, hydroxypropyl cellulose, hydroxypropyl methyl cellulose, ethyl hydroxyethyl cellulose, methyl ether starch, poly(n-isopropyl acrylamide), poly N-vinyl caprolactam, polyvinyl methyl oxazolidone, poly(2-isopropyl-2-oxazoline), poly(2, 4-dimethyl-6-triaziniyl ethylene) or a combination thereof.

The liner 20 may be formed in a flat sheet. The shape of the sheet may conform to the interior shape of the toilet bowl 16. Such shapes may include circles, ovals, octagons, etc. The size of the liner 20 may be determined by the circumference of the toilet bowl interior at a point above the water level 18. The liner 20 may comprise a substantially flat topography prior to use. The liner may include an unbroken center portion 24 surrounded by an outer portion divided into leaves 28 by slits 26 radiating from the center portion 24. The outer circumference 22 may be broken by a number of the slits projecting inward toward the center portion. The slits 26 may be in the form of wedge shaped darts such as is known in the sewing arts. FIG. 2 illustrates three separate shapes of the liner 20 sheets. The center portion 24 may be unbroken. The edge may be punctuated at regular intervals with wedge shaped darts or slits 26. These slits 24 may function to enclose the edge of the liner 20 into a pouch like shape when matter is deposited in the center.

The material of the liner 20 may also include other substances incorporated into or coated onto the liner 20. Such substances may include a fragrance dispersing substance, which may disperse a chemical scent. The scent may be emitted continuously or may be released upon contacting water. The fragrance may be beneficial in making the odors associated with the waste less noticeable. Another substance may include antiseptic or antibiotic substances to reduce the spread of germs associated with the waste. Yet another substance that might be included may be a friction reducing coating that may make the exterior of the liner slippery. The increased ease that such a coating would convey to the package of waste while passing through plumbing would diminish the possibility of causing blockages and obstructions. Still another substance may be enzymes and/or bacteria that may assist in decomposing the liner 20 and/or the waste. These biological decomposing substances, as is used in septic systems, may help in biodegrading the liner 20 and waste as well as keeping plumping free from blockages and build-up.

The shape of the liner 20 may provide the function of encompassing or wrapping waste deposited onto the center 24 of the liner 20. The leaves 28 formed by the slits 26 may move in around the waste to form into a pouch-like shape. Each leaf 28 may overlap or interleave with the leaves 28 to either side to conform and/or encapsulate the waste and prevent contact with the toilet bowl 16.

One or more liners may be stored ready for use in a liner dispenser 30. The liner dispenser may include a pocket for containing a number of liners 20. The pocket may support a number of liners 20 and may include retaining surfaces to hold a portion of the liner's mass. The liner dispenser may comprise a back 34 to which the pocket 32 may be a part. The back 34 may also include a wall mount 36 for attaching the liner dispenser to a wall. The mounting mechanism may take various forms, such as, for example, wall screws, two way tape, adhesives, a mounting bracket, wall hooks, hook and loop fastener pads, magnets, suction cups, etc. The liner dispenser may be mounted near a toilet 12 so that a potential user may have ready access to the liners 20 contained therein.

In use, the flushable bowl protecting liner 10 may be made available from a liner dispenser 30 located near a toilet 12. The user may take a liner 20 out of the wall mounted pocket and place it in the toilet bowl 16. The shape of the outer circumference 22 may be cut in a shape that would correspond to the shape of the toilet bowl. The size of the liner 20 may conform to the size of the toilet bowl 16 at a height above the water level 18. The user places the liner into the toilet bowl 16 parallel to the surface of the water. The liner 20 would set into the toilet bowl resting the outer circumference 22 of the liner on the inside surface of the toilet bowl. A liner 20 could be placed in the toilet 12 by the previous user, and the liner may remain dry and functional due to the fact that it would rest out of the water. When waste is being deposited onto the center 24 of the liner 20 the liner would tend to bulge toward the water and eventually contact the water. The water would soften the material of the liner 20 and make it more pliable. Five factors in the design of the liner 20 may help to form the liner into a convex shape and surround the waste. The first factor is the support of the weight of the waste in the center of a surface being supported by its outer circumference. Second, the lack of structural support of the liner 20 due to the radial slits 26 located along the outer circumference. Third, the increased flexibility of the center 24 portion when it contacts the water. Fourth, the pressure of the water surrounding the waste may tend to aid the liner enveloping the waste. As the waste descends further into the toilet bowl, an increasing area of liner would contact the water and become pliable. As the material of the liner is not specifically porous, the mass of the water would tend to aid in forming the liner material around the waste. The individual leaves 28 of the liner may tend to overlap or interleave with each other as the material surrounded the waste. The last factor in forming the liner material around the waste is the funnel shape of the bottom of the toilet bowl 16. This funnel shape may act as a mold forming the liner into a pouch like shape aided by the weight of the waste or the flushing action of the toilet 12. All of these factors may aid in the formation of a pouch like shape formed by the material of the liner 20. The liner may fully enclose the waste so that contact between waste and toilet bowl may not be possible. The waste enclosed in the package of the liner 20 can then be flushed away without fear of residual waste being deposited on the toilet bowl 16 surface.

As the package of waste and the wrap formed by the liner 20 maintain contact with water the liner may start to disperse. This is in accordance with the design of the liner 20 material to assure that the septic systems remain clear and that the waste is recoverable without undue process.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liner for preventing waste from contacting the surface of a toilet bowl, the liner comprising:

a sheet of water-sensitive material designed to maintain its structural integrity and strength when in use, but disperses when placed in contact with water, the sheet having an outer circumference, the sheet having a central portion uninterrupted by any breakages and an outer circumference comprising a plurality of leaves formed by slits radiating inwardly from the outer circumference toward the central portion.

2. The liner of claim 1 wherein the water-sensitive material includes a substance selected from the group consisting of polyethylene oxide, ethylene oxide-propylene oxide copolymers, polymethacrylic acids polymethacrylic acid copolymers, polyvinyl alcohol, poly(2-ethyl oxazoline), polyvinyl methyl ether, polyvinyl pyrrolidone/vinyl acetate copolymers, methyl cellulose, ethyl cellulose, hydroxypropyl cellulose, hydroxypropyl methyl cellulose, ethyl hydroxyethyl cellulose, methyl ether starch, poly(n-isopropyl acrylamide), poly N-vinyl caprolactam, polyvinyl methyl oxazolidone, poly(2-isopropyl 2-oxazoline), poly(2, 4-dimethyl-6-triaziniyl ethylene) or a combination thereof.

3. The liner of claim 1 wherein the material forming the liner includes a fragrances dispersing substance.

4. The liner of claim 1 wherein the material forming the liner includes an antiseptic substance.

5. The liner of claim 1 wherein the material forming the liner includes an antibiotic substance.

6. The liner of claim 1 wherein the material forming the liner includes a friction reducing coating.

7. The liner of claim 1 wherein the material forming the liner includes a decompositional enzyme.

8. The liner of claim 1 wherein the material forming the liner includes a decompositional bacterium.

9. The liner of claim 1 wherein the outer circumference of the sheet has a substantially circular shape.

10. The liner of claim 1 wherein the outer circumference of the sheet has a substantially octagonal shape.

11. A system for preventing waste from contacting the surface of a toilet bowl by deforming the substance of the liner to conform and encompassing the waste, the system comprising:

a liner that captures the waste and deforms to encompass the waste, the liner comprising:

a sheet of water-sensitive material designed to maintain its structural integrity and strength when in use, but disperses when placed in contact with water, the sheet having an outer circumference, the sheet having a central portion uninterrupted by any breakages and an outer circumference comprising a plurality of leaves formed by slits radiating inwardly from the outer circumference toward the central portion; and a liner dispenser for storing and making available liners to the user, the liner dispenser comprising:

a pocket having a plurality of the liners positioned therein;

a wall mount for mounting the liner dispenser to a wall; and a back joining the pocket and wall mount together.

12. The system of claim 11 wherein the water-sensitive material comprises a substance selected from the group consisting of polyethylene oxide, ethylene oxide-propylene oxide copolymers, polymethacrylic acids polymethacrylic acid copolymers, polyvinyl alcohol, poly(2-ethyl oxazoline), polyvinyl methyl ether, polyvinyl pyrrolidone/vinyl acetate copolymers, methyl cellulose, ethyl cellulose, hydroxypropyl cellulose, hydroxypropyl methyl cellulose, ethyl hydroxyethyl cellulose, methyl ether starch, poly(n-isopropyl acrylamide), poly N-vinyl caprolactam, polyvinyl methyl oxazolidone, poly(2-isopropyl 2-oxazoline), poly(2, 4-dimethyl-6-triaziniyl ethylene) or a combination thereof.

13. The system of claim 11 wherein the material forming the liner includes a fragrances dispersing substance.

14. The system of claim 11 wherein the material forming the liner includes an antiseptic substance.

15. The system of claim 11 wherein the material forming the liner includes an antibiotic substance.

16. The system of claim 11 wherein the material forming the liner includes a friction reducing coating.

17. The system of claim 11 wherein the material forming the liner includes a decompositional enzyme.

18. The system of claim 11 wherein the material forming the liner includes a decompositional bacterium.

* * * * *